United States Patent [19]

Thomas

[11] 4,279,389

[45] Jul. 21, 1981

[54] THREAD KEEPER

[76] Inventor: James K. Thomas, 21 Backkingdom Rd., Mexico, Me. 04257

[21] Appl. No.: 151,347

[22] Filed: May 19, 1980

[51] Int. Cl.[3] ..... B65H 59/04; B65H 49/26

[52] U.S. Cl. ..... 242/156.1; 242/129.51; 242/129.8; 242/134; 242/141

[58] Field of Search ..... 242/156.1, 156, 125.2, 242/125.3, 129.5, 129.51, 129.53, 129.8, 134, 136, 137, 137.1, 138, 141, 146, 75.4; 223/106

[56] References Cited

U.S. PATENT DOCUMENTS

| | | | |
|---|---|---|---|
| 212,893 | 3/1879 | Burgess | 242/125.3 X |
| 479,554 | 7/1892 | Carpenter | 242/156.1 X |
| 545,549 | 9/1895 | Strodel et al. | 242/156.1 X |
| 567,743 | 9/1896 | Griffith | 242/156.1 X |
| 577,258 | 2/1897 | Innes | 242/156.1 X |
| 891,185 | 6/1908 | McDowell | 242/156.1 X |
| 982,361 | 1/1911 | Hedenstrom | 242/156.1 |
| 1,398,347 | 11/1921 | Stott | 242/156.1 |
| 2,319,864 | 5/1943 | Holmes | 242/156.1 X |
| 2,542,758 | 2/1951 | Erickson | 242/129.51 X |

*Primary Examiner*—Stanley N. Gilreath
*Attorney, Agent, or Firm*—C. Yardley Chittick

[57] ABSTRACT

A thread keeper to prevent undesired unwinding of thread from a spool. The unit comprises a channel shaped element with the mid portion paralleling the axis of the spool and the two arms straddling the ends of the spool. The arms have short projections that enter the ends of the cylindrical bore through the spool whereby the spool can rotate within the keeper unit. The space between the mid portion of the keeper and the thread on the spool is filled with compressible friction applying material that expands to be in continuous braking engagement with the thread as it is pulled and unwound from the spool.

6 Claims, 5 Drawing Figures

THREAD KEEPER

BACKGROUND OF THE INVENTION

Devices for preventing the unwinding of thread from a spool are very old in the patented art. Up to the present, however, such devices have not, as far as applicant is aware, gone into use or even become available in the marketplace.

Since, for best results, each spool of thread in a sewing room should be equipped with a keeper, it follows that (1) the keeper should be small and uncomplicated so as not to increase appreciably the required storage space and (2) the cost should be low to minimize the initial purchase price of the quantity needed to equip all spools of which there might be several dozen in a typical household sewing room.

The invention will be described in more detail hereinafter with the aid of the accompanying drawings in which FIG. 1 is a side elevation of a full spool of thread with the keeper in position thereon.

Figure 1:
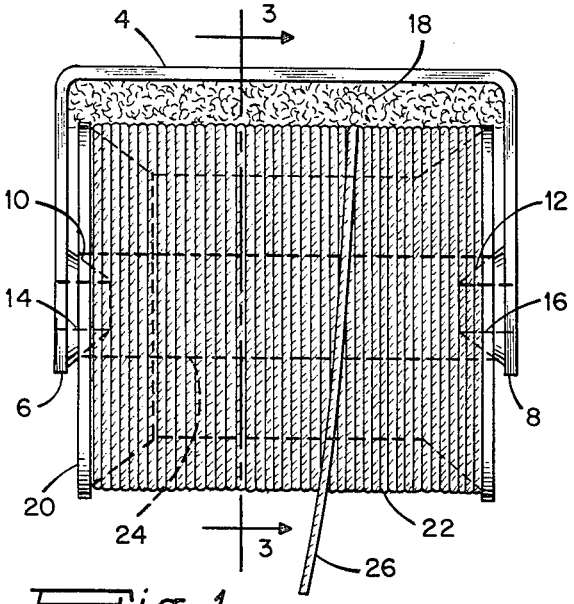

For clarity of illustration all of the above figures are drawn to enlarged scale as compared with a typical spool of thread.

DESCRIPTION OF A PREFERRED EMBODIMENT

The thread keeper in the several figures is referred to by the numeral 2. In the preferred construction it is made of a strip of strong plastic shaped as a U with a cross bar 4 and two parallel arms 6 and 8.

At the ends of the arms are short generally conical projections 10 and 12 shaped to fit within the ends of the axial cylindrical bore through the spool with which the keeper is used. The projections 10 and 12 which might also be cylindrical, form in effect an axle about which the spool can rotate within the keeper.

Preferably the projections 10 and 12 will have central openings 14 and 16 whereby the keeper equipped spools may be strung on a wire, cord or rod for easy access.

Between the arms 6 and 8 and attached securely to the inside surface of cross bar 4 (preferably by gluing or cementing) is a piece of very flexible compressible material 18 such as foam rubber. The characteristics of material 18 are important in the operation of the keeper. The material must be capable of being compressed substantially with the application of small force and have the ability to expand substantially as the pressure is removed. The material must have in addition a proper coefficient of friction to impose a small continuous restraint on the thread being drawn from the spool.

The unit 2 may be made in a number of different sizes so that all the spools currently used by the thread manufacturer may be accommodated. In some cases a single size of keeper may be used with two or more different sized spools if the spool dimensions are within acceptable limits. Best results are obtained however when the keeper is designed to fit a particular sized spool.

Figure 3:
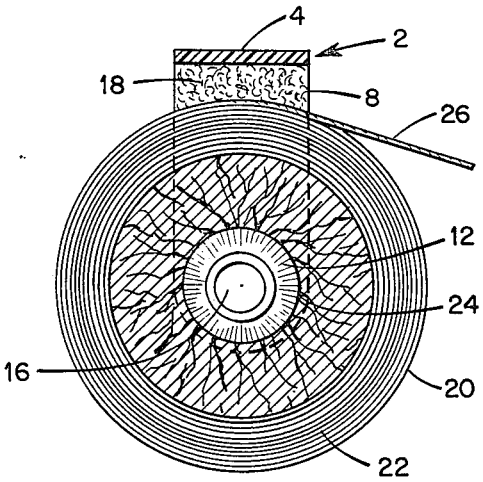
FIG. 3 is a sectional view taken on the line 3—3 of FIG. 1.

The disclosures in FIGS. 1 and 3 show a wood spool 20 completely filled with thread 22 wound thereon. The arms 6 and 8 straddle the ends of the spool and the short conical projections 10 and 12 are partially within the ends of the axial bore 24 extending through the spool.

The arms 6 and 8 are sufficiently flexible so that the keeper may be readily snapped into position on the spool as shown.

In FIGS. 1 and 3 the soft compressible rubber like frictional material 18 is shown as substantially compressed between cross bar 4 and the wound thread 22. In this condition, the compressed material which for ease of reference will hereinafter be called the brake, presses relatively lightly against the thread 22 and obviously prevents any unwinding of the thread from the spool when the assembly is unattended. In the other condition, when the end 26 of the thread is pulled by one hand while the keeper is being held by the other hand, the spool will turn readily on the pivots 10 and 12 as the thread unwinds overcoming the friction of the brake.

Figure 2:
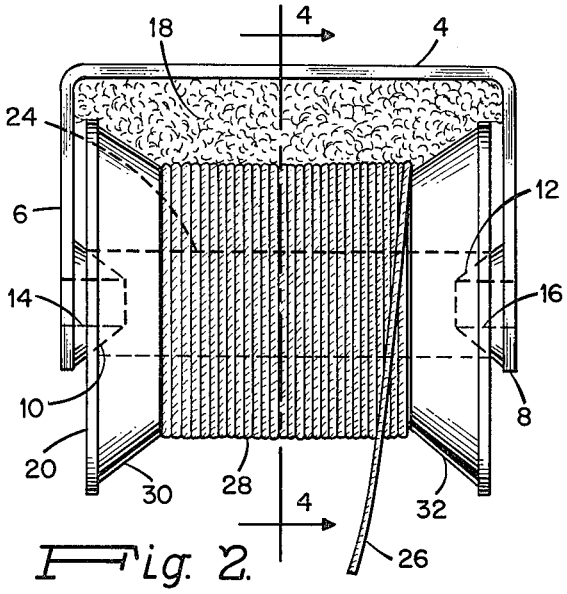
FIG. 2 is a side elevation similar to FIG. 1 with the spool almost empty.
Figure 4:
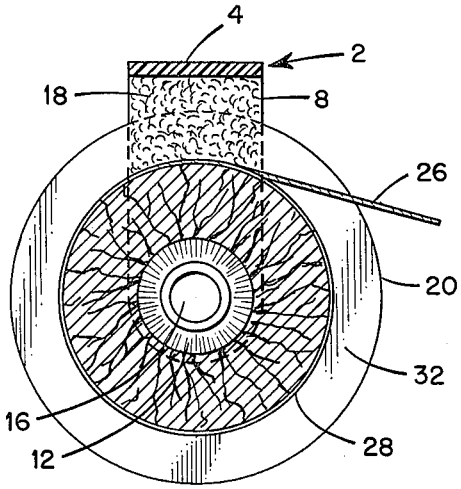
FIG. 4 is a sectional view taken on the line 4—4 of FIG. 2.
Figure 5:
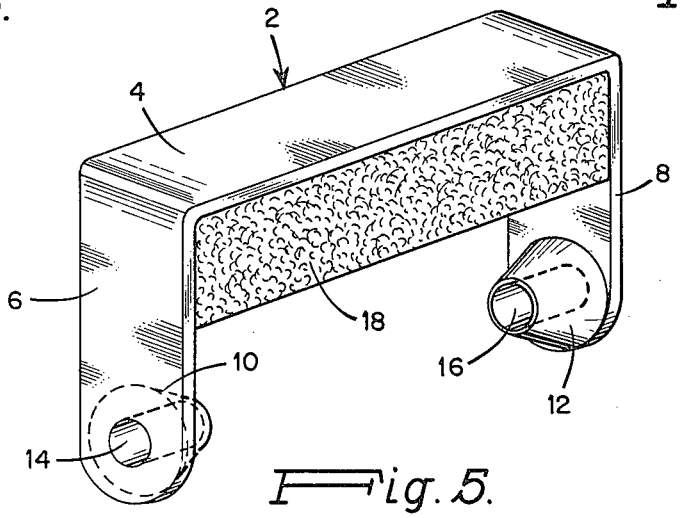
FIG. 5 is an isometric perspective view of the keeper per se.

As the diameter of the thread still on the spool gradually decreases as thread is withdrawn, the brake 18 correspondingly expands to maintain the desired braking effect until all of the thread has been expended. FIGS. 2 and 4 illustrate the brake in its maximum expanded condition as the last windings 28 are reached.

The nature of the brake material is such that it accommodates itself in the conical walls 30 and 32 of the spool while continuously maintaining the braking effect against undesired unwinding.

When the thread is exhausted, the keeper may be removed from the spool and placed on another thread containing spool. Since the cost of the keepers is small and they may be reused many times without loss of braking effect, the economic utility will suggest extensive use.

It will also be understood that the keepers may be made of any material strong and flexible enough to act in the manner explained above. The brake material as above mentioned is preferably of foam rubber which has compression and expansion characteristics that will meet the changing spool diameters while applying light frictional resistance to rotation of the thread covered spool within the keeper.

It is intended to cover all changes and modifications of the example of the invention herein chosen for purposes of the disclosure which do not constitute departures from the spirit and the scope of the invention.

I claim:

1. A thread keeper for use with a spool of thread in which said spool has an axial bore therethrough, said keeper comprising a U shaped unitary structure having a cross bar and two flexible arms sized to straddle said spool, projections on said arms positioned to enter the ends of said axial bore to act as an axle about which said spool may rotate, said cross bar spaced from said spool, a compressible element attached to the interior side of said cross bar and engaging in compressed condition the thread on said spool, whereby said compressible element will apply to said threaded spool continuous limited restraint against rotation within said keeper.

2. A thread keeper as set forth in claim 1, said compressible element engaging at least a majority of the thread windings on said spool.

3. A thread keeper as set forth in claim 1,
said compressible element when fully expanded reaching to said spool at its section of minimum diameter.

4. A thread keeper as set forth in claim 1,
said element capable of being compressed into the space between said cross bar and the thread on a full spool and capable of expanding sufficiently to engage the spool when empty whereby resistance to rotation of said threaded spool within said keeper will be continuously present during the entire withdrawing of thread from said spool.

5. A thread keeper as set forth in claim 1,
all of said structure being made of plastic and said compressible element being of sponge rubber.

6. A thread keeper as set forth in claim 5,
said projections being in the form of truncated cones with axial holes therethrough.

* * * * *